US005363782A

United States Patent [19]

Couwels

[11] Patent Number: 5,363,782

[45] Date of Patent: Nov. 15, 1994

[54] APPARATUS AND PROCESS FOR COMBUSTING FLUID FUEL CONTAINING SOLID PARTICLES

[75] Inventor: Ludo J. C. Couwels, Oelegem-Ranst,

[73] Assignee: Praxair Technology, Inc., Danbury, Conn.

[21] Appl. No.: 161,520

[22] Filed: Dec. 6, 1993

[51] Int. Cl.[5] ..... F23G 7/04

[52] U.S. Cl. ..... 110/238; 110/263; 110/264; 110/265; 431/8; 431/10; 431/187

[58] Field of Search ..... 110/238, 261–265; 431/8, 10, 187

[56] References Cited

U.S. PATENT DOCUMENTS

| | | | |
|---|---|---|---|
| 3,589,315 | 6/1971 | Hart | 110/265 |
| 4,457,241 | 7/1984 | Itse et al. | 110/265 |
| 4,523,529 | 6/1985 | Poll | 110/263 |
| 4,575,332 | 3/1986 | Oppenberg | 431/9 |
| 4,614,159 | 9/1986 | Sugiura et al. | 110/263 |
| 4,679,512 | 7/1987 | Skoog | 110/264 |
| 4,858,538 | 8/1989 | Kuypers et al. | 110/264 |
| 4,865,542 | 9/1989 | Hasenack et al. | 110/265 |
| 4,907,961 | 3/1990 | Anderson | 431/8 |
| 5,104,310 | 4/1992 | Saltin | 431/10 |
| 5,127,346 | 7/1992 | Kepplinger et al. | 110/264 |
| 5,129,333 | 7/1992 | Frederick et al. | 110/238 |
| 5,129,335 | 7/1992 | Lauwers | 110/346 |
| 5,161,967 | 11/1992 | Rietzscher et al. | 110/265 |
| 5,188,042 | 2/1993 | Lauwers | 110/346 |

OTHER PUBLICATIONS

Brazilian Patent Application No. 8503088, "Process for Combustion of Combustible Material", Wilfried Lissack et al. Mar. 11, 1986. (translation provided).

*Primary Examiner*—Henry C. Yuen
*Attorney, Agent, or Firm*—Chung K. Pak

[57] ABSTRACT

Apparatus and process for improving atomization and combustion of fuel containing solid particles, wherein the fuel containing solid particles is ejected from an outlet port having a conical or trumpet end-like internal wall surface and a fuel atomizing fluid is ejected from a plurality of bores present in the conical or trumpet end-like internal wall surface of the outlet port.

9 Claims, 2 Drawing Sheets

Fig. 2
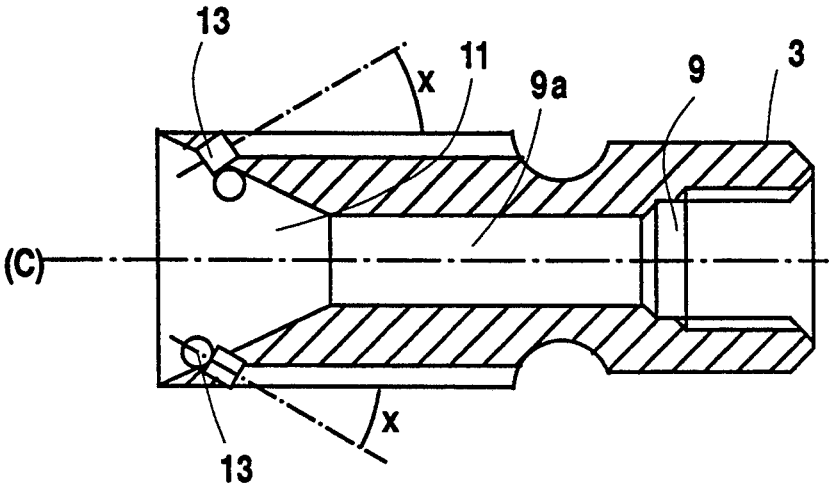
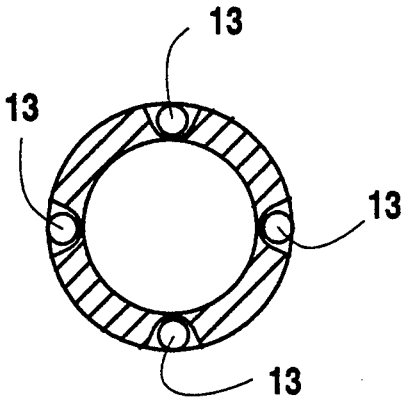
Fig. 3
Fig. 4
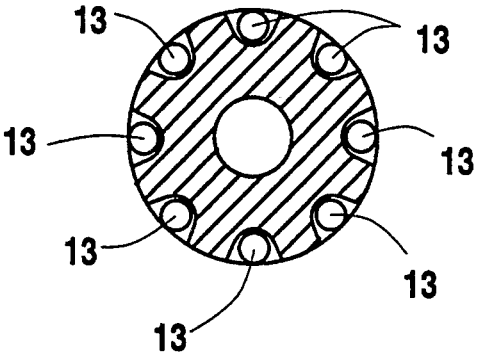

APPARATUS AND PROCESS FOR COMBUSTING FLUID FUEL CONTAINING SOLID PARTICLES

FIELD OF THE INVENTION

The present invention relates generally to apparatus and processes for combusting fluid fuel containing solid particles and, more particularly, to apparatus and processes for combusting liquid fuel contaminated by solid particles, e.g., liquid waste containing solid particles.

BACKGROUND OF THE INVENTION

Conventional burners generally comprise fuel passageways for emitting fluid fuel and oxidant passageways for emitting oxidant, as shown by, for example, U.S. Pat. No. 5,104,310 and Brazilian Patent No. 8,503,088. The fluid fuel, such as oil, employed in the conventional burners is normally filtered before it is ejected through the fuel passageways of the conventional burners. By filtering the fuel, the fuel is prevented from clogging the fuel passageways. When the fluid fuel involved is heavy oil or liquid waste, filtering it adequately for the fuel passageways of the conventional burners is very difficult, if not economically unfeasible. Often, this fluid fuel can contain solid particles with a dimension of up to 10 mm, which can clog, block or obstruct the fuel passageways of the conventional burners.

In order to prevent such fluid fuel from clogging the fuel passageways, a nozzle assembly capable of passing a fluid fuel containing solid particles is employed to eject the fluid fuel. The nozzle assembly has a fuel or waste passageway having a diameter which is larger than the size of the largest particles in the fluid fuel. U.S. Pat. No. 5,129,333, for example, discloses a centrally located waste nozzle assembly for ejecting waste matter gravitationally, mechanically or pneumatically. This nozzle assembly is not indicated to be used for ejecting waste matter containing solid particles. If, however, it is used to eject waste matter containing solid particles having dimensions of up to 10 mm, the nozzle assembly must have a large diameter passageway capable of conveying or passing such solid particles. The large diameter passageway, however, adversely affects atomization or dispersement of the fluid fuel. Since failure to atomize or disperse fluid fuel sufficiently can prevent complete and stable combustion of the fluid fuel, a substantial amount of a fluid fuel atomizing or dispersing fluid, such as steam or air, is needed under substantial pressure to atomize or disperse the fluid fuel from the nozzle having the large diameter passageway.

Accordingly, there is a genuine need for effective and efficient atomization or dispersement of the fluid fuel containing solid particles, e.g., liquid waste contaminated with solid particles, in order to promote stable and effective combustion of the fluid fuel containing solid particles.

SUMMARY OF THE INVENTION

The above need is fulfilled by the present invention which is drawn to a process and apparatus for combusting fluid fuel containing or contaminated by solid particles.

The process comprises:

(a) injecting said fluid fuel containing solid particles through a nozzle having an outlet port defined by a diverging conical or trumpet end internal wall surface;

(b) ejecting a fluid fuel atomizing or dispersing fluid from a plurality of bores located at said diverging conical or trumpet end internal wall surface of said outlet port;

(c) thrusting or pushing said fluid fuel containing solid particles just before said fluid fuel leaves said outlet port, thus enhancing atomization or dispersement of said fluid fuel containing solid particles; and (d) combusting the resultant atomized or dispersed fluid fuel containing solid particles with oxidant.

The fluid fuel atomizing or dispersing fluid may be ejected at an angle and a velocity, which are sufficient to cause the formation of a substantially homogeneous mixture containing the fluid fuel and the fluid fuel atomizing or dispersing fluid. If the fluid fuel atomizing or dispersing fluid contains oxygen, the formation of the substantially homogeneous mixture, in turn, causes partial combustion of the fluid fuel before it is completely combusted with the oxidant The burner comprises:

(a) a nozzle having a passageway capable of passing liquid fuel containing solid particles and an outlet port having a diverging conical or trumpet end internal wall surface, said diverging conical or trumpet end internal wall surface being in fluid communication with said passageway and having a plurality of bores radially spaced from the central axis of said passageway, said bores having a diameter or cross-sectional area smaller than the diameter or cross-sectional area of said passageway; and (b) a housing means surrounding said nozzle and being coupled to said outlet port to form an annular passageway which is in fluid communication with said plurality of bores.

The housing means may have a discharge end section which extends beyond the outer end of said outlet port to form a chamber capable of accommodating partial combustion of fluid fuel containing solid particles. The discharge end section of the housing means can optionally be flared outwardly away from the longitudinal axis of said housing means to prevent any liquid fuel from accumulating within the chamber. An additional housing means may be provided to surround the housing means to form an additional annular passageway therebetween for passage of oxidant.

As used herein, the term "a fluid fuel atomizing or dispersing fluid" includes, among other things, air, oxygen enriched air, pure oxygen, nitrogen, steam, or other gases which are useful for dispersing or atomizing fluid fuel.

As used herein the term "substantially homogeneous mixture" or "homogeneous mixture" means a thoroughly, uniformly or well mixed mixture containing a fluid fuel containing solid particles and a fluid fuel atomizing or dispersing fluid.

As used herein the term "a plurality of bores" means two or more bores.

BRIEF DESCRIPTION OF THE DRAWINGS

FIG. 2 illustrates a cross-sectional view of an internal nozzle of the burner shown in FIG. 1.

FIGS. 3 and 4 show front views of internal nozzles having a different number of bores, which are another embodiment of the invention.

DETAILED DESCRIPTION OF THE INVENTION

Figure 1:
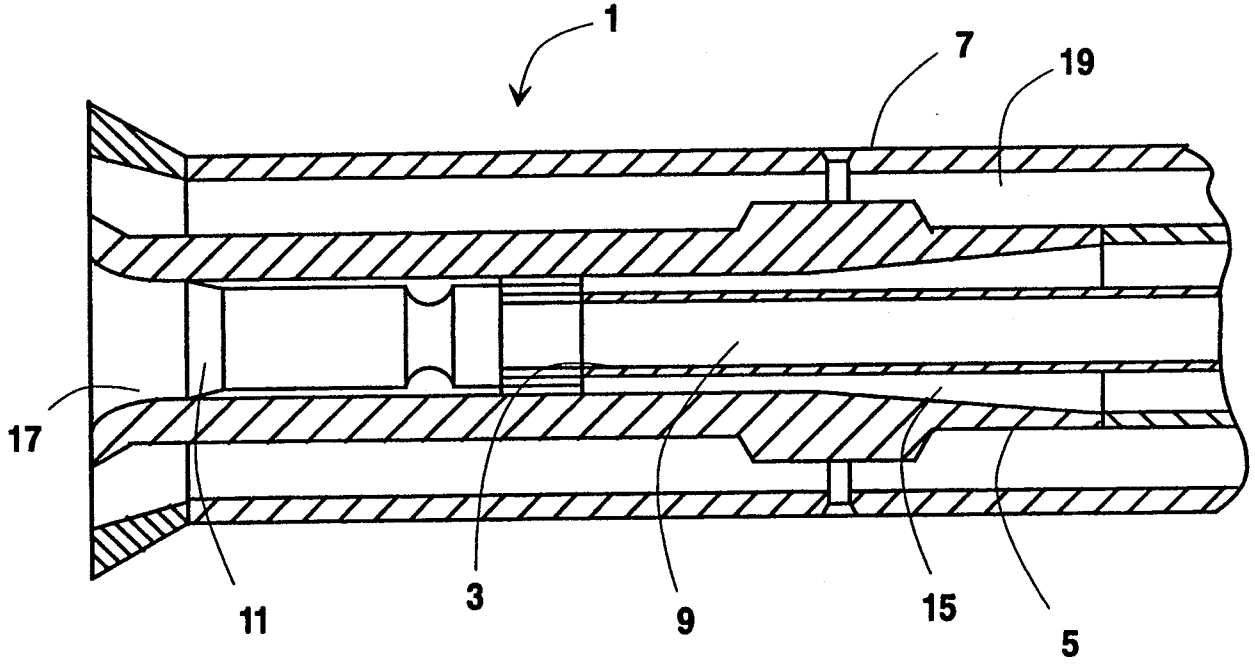
FIG. 1 illustrates a cross-sectional view of a frontal section of a burner, which is one embodiment of the invention.

The preferred embodiment of the present invention will be described in detail with reference to FIGS. 1–4. The preference for this embodiment, however, in no way precludes numerous variations of this embodiment, which will become apparent or obvious to one of ordinary skill in this technology.

Referring to FIGS. 1–4, there is illustrated a burner (1) which comprises, among other things, an internal nozzle (3), a first housing means (5) and a second housing means (7). The internal nozzle (3) has a passageway (9) and an outlet port (11). The outlet port (11) has an internal wall surface in the form of a cone or trumpet end. On the conical or trumpet end internal wall surface of the outlet port (11), a plurality of bores (13) are present. The first housing means (5) surrounds the internal nozzle (3) to form an annular passageway (15) therebetween and is attached or coupled to the outer end of the outlet port (11) to direct any fluid in the annular passageway (15) to the bores (13). The first housing (5) has a discharge end section which may extend beyond the outlet port (11) to form a chamber (17) in front of or downstream of the outlet port (11) The second housing means (7) surrounds the first housing means (5) to form an additional annular passageway (19) therebetween. A cooling jacket (not shown) may be provided on the outer surface of the first and/or second housing means (5 and/or 7) to circulate a cooling fluid on the outer surface of the first and/or second housing means (5 and/or 7), thus preventing or minimizing damage to the burner during combustion operation.

The internal nozzle (3) and housing means (5 and 7) may be cylindrical and may be made with various high temperature, chemical and corrosion resistant materials, such as nickel and high nickel alloys sold under the trademark "MONEL®", "INCONEL®" or "INCOLY®". These high nickel alloys generally contain about 30 to 80% nickel by weight, about 0 to 50% iron by weight, about 0 to 50% chromium by weight and optionally about 0.5 to 35% by weight of other metals, such as titanium, copper, aluminum, cobalt and/or molybdenum. The percentage of iron or chromium is preferably varied from about 1 to 48% by weight.

Fluid fuel is fed to the passageway (9) of the internal nozzle (3). The fuel passing through the passageway (9) is injected through the outlet port (11) having the diverging conical or trumpet end internal wall surface. If the passageway (9) has an orifice or restricted passageway section (9*a*) having a diameter smaller than the diameter of the remaining passageway just before the outlet port (11), the fuel passing the orifice or restricted passageway section (9*a*) is pressurized and then is expanded at the diverging conical or trumpet end internal wall surface of the outlet port (11). This orifice or restricted passageway (9*a*) increases the velocity of the fluid fuel just before it is ejected through the conical or trumpet end internal wall surface of the outlet port (11). The fluid fuel employed may be any fluid containing solid fuel or solid fuel and solid contaminants or any fluid fuel containing any solid particles. Generally, the fluid fuel involved is liquid fuel containing or contaminated by solid particles having a dimension of about 0.000001 to about 10 mm. The term "liquid fuel" includes, among other things, heavy oil or liquid waste containing or contaminated by solid particles.

Fluid fuel atomizing or dispersing fluid is provided to the annular passageway (15) in order to eject the fluid fuel atomizing or dispersing fluid through a plurality of bores (13) located on the conical or trumpet end internal wall surface of the outlet port (11). This allows the fluid fuel atomizing or dispersing fluid to thrust or push the expanded fluid fuel stream just before the fluid fuel stream leaves the conical or trumpet end internal wall surface of the outlet port (11), thus causing enhanced atomization or dispersement of the fluid fuel. The fluid fuel is effectively atomized or dispersed even though the fluid fuel atomizing or dispersing fluid is ejected at a low velocity. Desirably, the fluid fuel atomizing fluid is ejected at a volumetric rate at sonic velocity of at least about 20 $nm^3$/hour, preferably about 50 $nm^3$/hour to about 70 $nm^3$/hour. In order to increase the volumetric rate or promote the obtention of the desired volumetric rate of the fluid fuel atomizing or dispersing fluid, the bores (13) can be designed to have a diameter or a cross-sectional area smaller than the diameter or the cross-sectional area of the annular passageway (15). Generally, the diameter of the bores (13) is about 1.5 mm to about 3 mm, preferably about 2 mm. The bores (13) are normally spaced radially away from the central axis (c) of the internal nozzle (3) or the passageway (9) and are located at the periphery of the conical or trumpet end shape internal wall surface of the outlet port (11) to evenly distribute the fluid fuel atomizing or dispersing fluid. The bores (13) may be designed to provide swirling effects to the fluid fuel atomizing or dispersing fluid ejected therefrom. Any known design, including at least partially twisted bores, may be employed for such purposes.

The fluid fuel ejected though the conical or trumpet end shaped outlet port (11) may be initially atomized or dispersed with the fluid fuel atomizing or dispersing fluid in the optional chamber (17). The optional chamber (17) has a length of about 10 mm to about 20 mm, preferably about 15 mm, so that the chamber (17) provides a void volume sufficient to accommodate partial combustion of fluid fuel. Through ejecting the fluid fuel atomizing or dispersing fluid at an angle with respect to the flow direction of the fluid fuel, the formation of a substantially homogeneous mixture or a homogeneous mixture containing the fluid fuel and the fluid fuel atomizing or dispersing fluid is promoted. The bores (13) may be inclined or slanted toward the direction of the central axis (c) of the passageway (9) to eject the fluid fuel atomizing or dispersing fluid at the desired angle. The bores (13) are normally inclined or slanted at an angle ranging from about 30° to about 60°, preferably from about 45°, measured from the longitudinal axis of the nozzle (3) (an angle defined by x).

When the fluid fuel atomizing or dispersing fluid contains oxygen, e.g., oxygen enriched air and pure oxygen, the formation of the substantially homogeneous mixture causes partial combustion of the fluid fuel therein with the oxygen therein within the chamber (17). The use of an oxygen enriched air or pure oxygen as a fluid fuel atomizing or dispersing fluid is normally preferred since such a fluid reduces the presence of an unproductive inert gas, i.e., nitrogen, minimizes the formation of $NO_x$ and promotes partial combustion of the fluid fuel in the chamber (17). The chamber (17) may be designed to provide a conical or trumpet end shape volume by flaring the discharge end section of the first housing means (5) outwardly away from the longitudinal axis of the first housing means (5). Preferably, the discharge end section of the first housing means flares outwardly at an angle ranging from about 10° to about 30°, measured from the central axis (c) of the first housing means (5). This design allows the formation of a shorter flame during combustion operation and prevents the accumulation of liquid fuel within the chamber (17), i.e., allows liquid fuel to flow out of the chamber (17), after combustion operation.

Oxidant is provided through the additional annular passageway (19) to combust either the atomized or dispersed fluid fuel or the partially combusted fluid fuel from the chamber (17). The oxidant employed can be air, oxygen enriched air or pure oxygen. The desired oxidant has preferably an oxygen concentration of greater than about 25 percent by volume, more preferably an oxygen concentration of greater than about 30 percent by volume. This oxidant envelopes the atomized or dispersed fluid fuel or the partially combusted fluid fuel, preferably at a high velocity, to effect complete combustion of the fluid fuel. The oxidant is normally ejected at a velocity of about 80 m/sec to about 150 m/sec from the discharge outlet of the additional annular passageway (19). If liquid waste or other liquid fuel is employed, the discharge section of the second housing means (7) should be flared outwardly away from the longitudinal axis of the second housing means so that the liquid waste or other liquid fuel dripping from the chamber (17) or from the conical or trumpet end internal wall surface of the outlet port (11) is prevented from entering the passageway (19), thus reducing the risk associated with ignition and possibly explosion due to liquid fuel in the oxidant passageway (19). The discharge end section of the second housing means (7) is preferably flared outwardly at an angle ranging from about 10° to about 30°, measured from the central axis (c) of the second housing means.

By using the methods and/or apparatus of the present invention, the fluid fuel containing solid particles can be effectively and efficiently atomized or dispersed without employing a substantial amount of a fluid fuel atomizing or dispersing fluid and without clogging the fuel passageway. The atomization or dispersement can be effectively carried out even if the fluid fuel is not introduced under high pressure. Once atomization or dispersement is enhanced, the fluid fuel can be efficiently and effectively combusted since the fluid fuel is well distributed to react with oxidant. If the combustion temperature needs to be lowered, the fluid fuel can be partially combusted in an initial combustion zone, i.e., the chamber (17), through forming a substantially homogeneous mixture containing the fluid fuel and the fluid fuel atomizing or dispersing fluid containing oxygen and then completely combusted in a subsequent combustion zone, i.e., outside the chamber (17), in the presence of oxidant. When oxygen enriched air or pure oxygen is used as a fluid fuel atomizing or dispersing fluid, a large volume of the fluid fuel can be combusted with the reduced $NO_x$ formation since partial combustion of the fluid fuel with oxygen enriched air or pure oxygen can be carried out at a low temperature with the reduced nitrogen presence.

Although the invention has been described in detail with reference to certain preferred embodiments, those skilled in the art will recognize that there are other embodiments of the invention within the spirit and scope of the claims.

What is claimed is:

1. A process for combusting liquid fuel containing solid particles, the process comprising:
   (a) ejecting said liquid fuel containing solid particles through a nozzle having an outlet port defined by a diverging conical or trumpet end internal wall surface;
   (b) ejecting a liquid fuel atomizing or dispersing fluid at a volumetric rate at sonic velocity ranging from about 30 $nm^3$/hour to about 70 $nm^3$/hour from a plurality of bores located at said diverging conical or trumpet end internal wall surface of said outlet port;
   (c) thrusting or pushing said liquid fuel containing solid particles just before said liquid fuel leaves said outlet port, thus enhancing atomization or dispersement of said liquid fuel containing solid particles; and
   (d) combusting the resultant atomized or dispersed liquid fuel containing solid particles with oxidant.

2. The process according to claim 1, wherein said liquid fuel is liquid waste containing solid particles.

3. The process according to claim 2, wherein said liquid fuel atomizing or dispersing fluid is an oxygen enriched air or pure oxygen.

4. The process according to claim 3, further comprising partially combusting said liquid fuel with said liquid fuel atomizing or dispersing fluid by forming a substantially homogeneous mixture containing said liquid fuel and said liquid fuel atomizing or dispersing fluid, before being combusted with said oxidant in step (d).

5. The process according to claim 4, wherein said liquid fuel atomizing or dispersing fluid is ejected at an angle ranging from about 30° to about 60°, measured from the longitudinal axis of said nozzle.

6. A burner capable of burning liquid fuel containing solid particles, said burner comprising:
   (a) a nozzle having a passageway capable of passing liquid fuel containing solid particles and an outlet port having diverging conical or trumpet end internal wall surface, said diverging conical or trumpet end internal wall surface being in fluid communication with said passageway and having a plurality of bores at said wall surface radially spaced from the central axis of said passageway, said bores having a diameter or cross-sectional area smaller than the diameter or cross-sectional area of said passageway;
   (b) a housing means surrounding said nozzle and being coupled to said outlet port to form an annular passageway which is in fluid communication with said bores; and
   (c) an additional housing means surrounding said housing means to form an additional annular passageway therebetween for passage of oxidant.

7. The burner according to claim 6, wherein said housing means has a discharge end section which extends beyond the outer end of said outlet port to form a chamber capable of accommodating partial combustion of liquid fuel containing solid particles.

8. The burner according to claim 6, wherein said bores are slanted at an angle ranging from about 30° to about 60°, measured from the longitudinal axis of said nozzle and have a diameter ranging from about 1.5 mm to about 3 mm.

9. The burner according to claim 6, wherein said passageway of said nozzle having an orifice or restricted section having a diameter or cross-sectional area smaller than the diameter or cross-sectional area of the remaining passageway of said nozzle.

* * * * *